United States Patent [19]

Hunter

[11] 4,320,993

[45] Mar. 23, 1982

[54] TENSION LEG PLATFORM MOORING TETHER CONNECTOR

[75] Inventor: Andrew F. Hunter, Houston, Tex.

[73] Assignee: Conoco Inc., Ponca City, Okla.

[21] Appl. No.: 172,628

[22] Filed: Jul. 28, 1980

[51] Int. Cl.[3] ..... B63B 21/50

[52] U.S. Cl. ..... 405/224; 114/265; 403/326; 405/202

[58] Field of Search ..... 405/195, 202, 224; 114/264, 265; 166/217; 285/307, 321; 403/326, DIG. 6

[56] References Cited

U.S. PATENT DOCUMENTS

| | | | |
|---|---|---|---|
| 3,563,042 | 2/1971 | Ryan | 405/202 |
| 3,731,955 | 5/1973 | Borsum et al. | 285/307 |
| 3,773,360 | 11/1973 | Timbers | 285/307 |
| 3,887,222 | 6/1975 | Hammond | 285/307 |
| 3,961,490 | 6/1976 | Corgnet | 405/224 X |
| 4,180,349 | 12/1979 | van Bilderbeek | 405/224 |
| 4,248,549 | 2/1981 | Czerewaty | 405/224 |

*Primary Examiner*—David H. Corbin
*Attorney, Agent, or Firm*—Reinert A. Joe

[57] ABSTRACT

A connector apparatus for connecting a tension leg platform mooring tether to a subsea foundation, the apparatus comprising: a plug positioned on the lower end of the mooring tether for mating union with a receptacle positioned in the foundation so that the plug is readily positioned in the receptacle to maintain the mooring tether in connection with the foundation with the plug being readily removable from the receptacle when desired.

9 Claims, 3 Drawing Figures

TENSION LEG PLATFORM MOORING TETHER CONNECTOR

This invention relates to a connector for connecting a tension leg platform mooring tether to a subsea foundation.

In view of the recent well publicized worldwide shortage of petroleum products and the resulting increased prices for petroleum, continuing efforts have been made to discover and produce petroleum from increasingly hostile environments. Such hostile environments include, arctic regions, deeper subsea subterranean formations which were previously considered unsuitable for the production of petroleum etc. Recently, attempts to produce petroleum from such subsea formations have been directed to the use of tension leg platforms. Such platforms comprise a buoyantly supported platform which is maintained in position by mooring tethers, also called tension members, etc., which are joined to the platform at their upper end and to a foundation positioned on the ocean floor at their lower end to maintain the platform in a desired position. The mooring tethers are maintained in tension to maintain the tension leg platform at a relatively constant position with respect to the sea floor. In other words, the mooring tethers are maintained in tension by the bouyancy of the platform so that the platform does not rise and fall with waves, tides and the like.

The following U.S. Patents were considered in the preparation of the present application.

U.S. Pat. No. 3,887,222
U.S. Pat. No. 3,773,360
U.S. Pat. No. 3,731,955
U.S. Pat. No. 4,138,148
U.S. Pat. No. 4,093,279
U.S. Pat. No. 3,695,633

In the use of such platforms, the mooring tethers used to anchor the tension leg platform in place are desirably joinable to the foundation on the ocean floor with a minimum of difficulty. It is also desirable that the mooring tethers be removable with a minimum of difficulty for periodic routine inspection for safety reasons or in compliance with various regulations or the like.

In has now been found that mooring tethers are readily connected to a subsea foundation with a minimum of difficulty and are readily removed from the subsea foundation by the use of a connector apparatus comprising:

(a) a plug means positioned on the lower end of said mooring tether;

(b) a receptacle means positioned in said foundation, said receptacle means having a first inner diameter larger than the outer diameter of said plug and being adapted to receive said plug;

(c) a first shoulder means positioned in said receptacle means;

(d) a second shoulder means positioned in said receptacle beneath said first shoulder means;

(e) a second inner diameter section in said receptacle, said second inner diameter section being larger than said first inner diameter section and positioned beneath said first shoulder means and above said second shoulder means;

(f) a compressible load ring means positioned in a groove means in said plug, said compressible load ring having an outer diameter larger than said first inner diameter of said receptacle means and including on its lower side compression means for compressing said load ring into said groove as said load ring is passed into said first inner diameter in said receptacle means to a diameter no larger than said first inner diameter of said receptacle means, said load ring being adapted to engage said groove and said first shoulder after passing through said first inner diameter section; and, (g) a compression ring means having an outer diameter smaller than said second inner diameter section and an inner diameter substantially equal to said first inner diameter of said receptacle means, said compression ring means being slideably positioned in said second inner diameter section between said first shoulder means and said second shoulder means and adapted to compress said load ring when said plug means is lowered in said receptacle means so that as said plug means is passed into said receptacle means said load ring is compressed until said load ring has passed through said first inner diameter section of said receptacle means, with said load ring then returning to its uncompressed diameter and engaging said first shoulder means and said groove means and retaining said plug means in said receptacle means with said load ring being compressible by said compression ring upon lowering said plug means further in said second inner diameter in said receptacle means thus passing said load ring means into compressing engagement with said compression ring means which is urged into compressing engagement with said load ring by contact with said second shoulder means.

In the discussion of the Figures, the same numbers will be used throughout to refer to the same or similar components.

Figure 1:
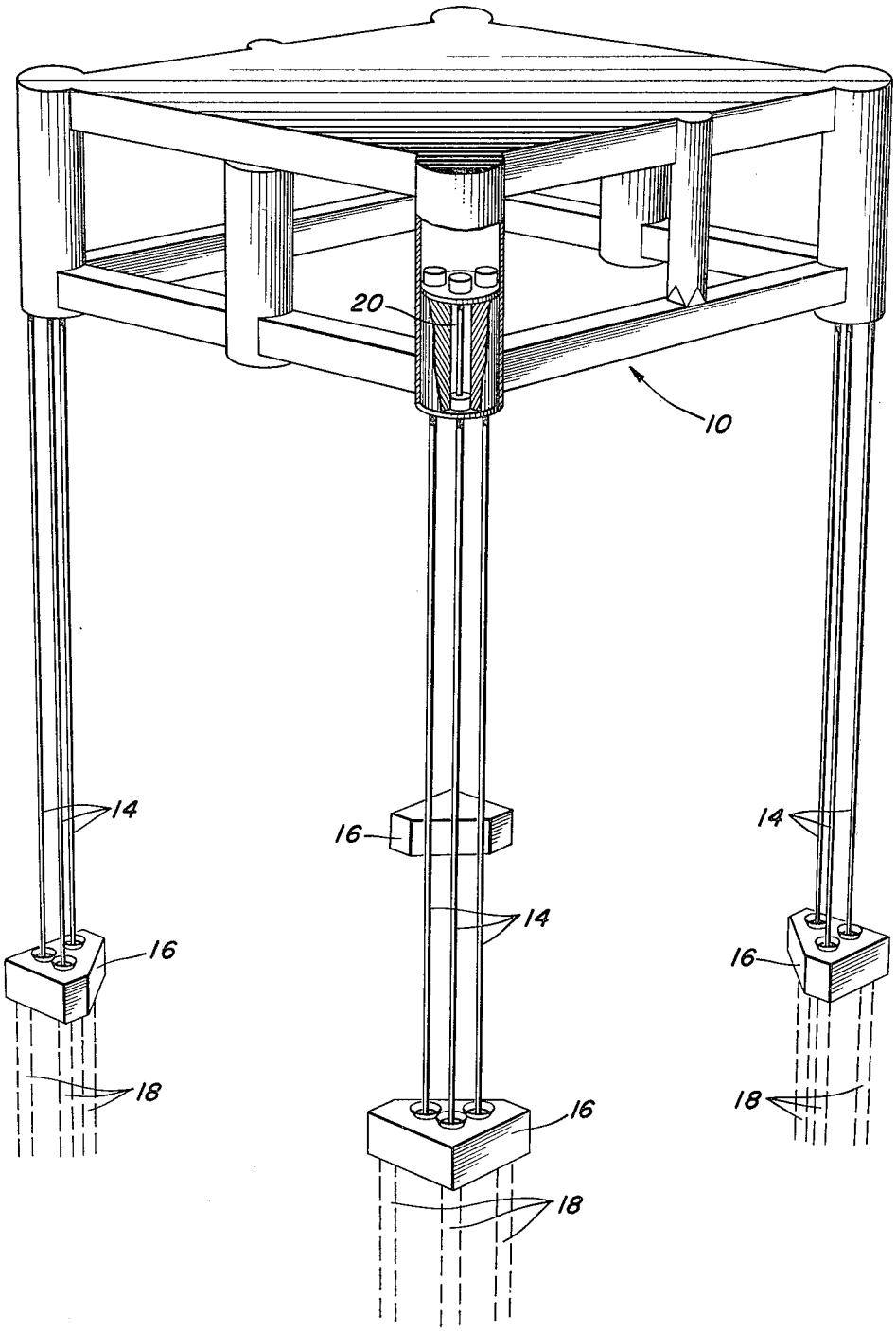
FIG. 1 is a schematic drawing of a tension leg platform.

In FIG. 1, a tension leg platform 10 is shown positioned over a subsea foundation 16. Platform 10 is maintained in position over foundation 16 by a plurality of mooring tethers 14. Foundation 16 as shown is anchored by pilings 18 to the ocean floor. It will be clearly understood that the use of pilings and the like, to secure foundation 16 to the ocean floor is known to the art and that the method of positioning the foundation on the ocean floor forms no part of the present invention. Mooring tethers 14 are joined to foundation 16 and thereafter placed in tension by de-ballasting platform 10, by use of tensioners 20 shown schematically in platform 10 or the like. The use of tensioners is considered to be known to the art and does not constitute a portion of the present invention per se.

Figure 2:
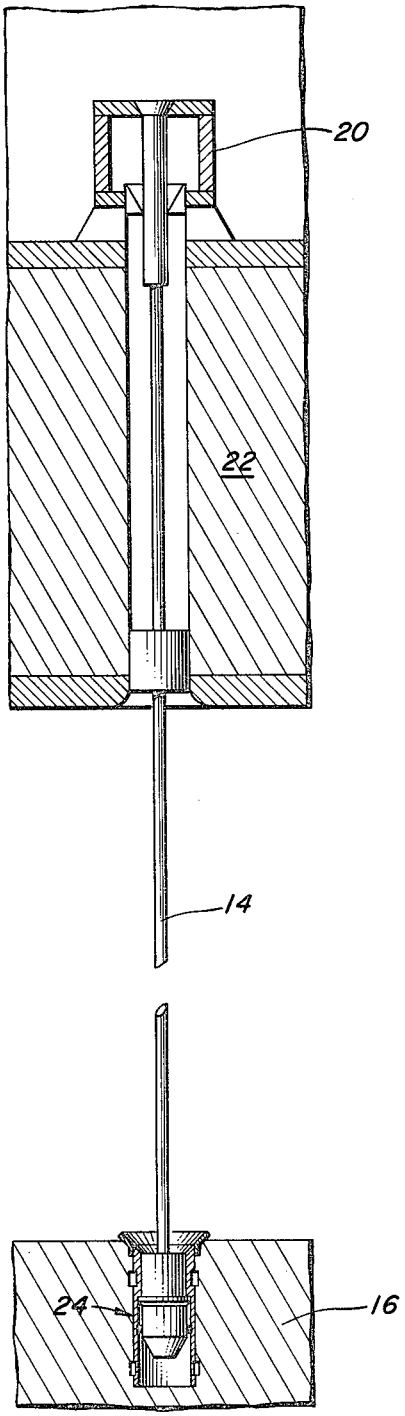
FIG. 2 is a view of a mooring tether used to position the tension leg platform of FIG. 1 in position; and, FIG. 3 shows a cross-sectional view of the connector of the present invention.

FIG. 2 shows the use of a connector 24 in accordance with the present invention in use to connect a mooring tether 14 to a subsea foundation 16. Tensioner 20 is shown in somewhat greater detail as positioned in a section 22 of platform 10.

Figure 3:
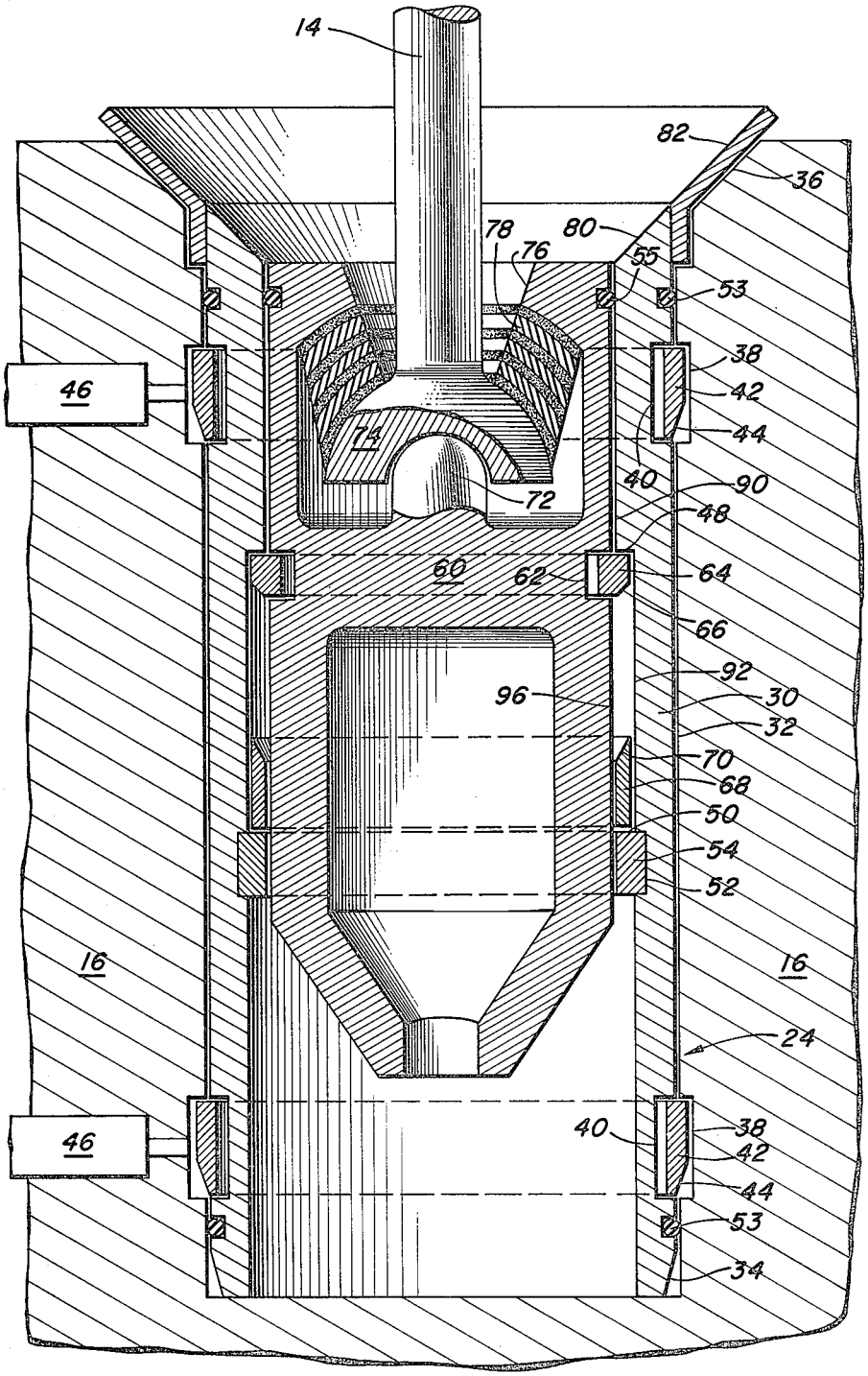

In FIG. 3, connector 24 of the present invention is shown. Connector 24 includes an insert sleeve 30 positioned in an opening 32 in foundation 16. Desirably, the upper end of sleeve 30 includes a tapered surface 80 with the taper sloping toward the inner diameter of sleeve 30. Further, sleeve 30 also desirably includes a tapered surface 34 on its lower outer diameter to facilitate the positioning of sleeve 30 in opening 32. Sleeve 30 is maintained in position in opening 32 by a pair of snap rings 42 positioned to engage grooves 38 positioned in foundation 16 and grooves 40 positioned on the outer diameter of sleeve 30. Desirably snap rings 42 have a tapered surface 44 on their lower outer diameter to facilitate the positioning of sleeve 30 in foundation 16. In a preferred embodiment, snap rings 42 are positioned in place in grooves 40 with sleeve 30 then being pushed downwardly into opening 32 with snap rings 42 being compressed into grooves 40 so that sleeve 30 slides downwardly into opening 32 with snap rings 42 resiliently expanding to engage grooves 38 and 40 when sleeve 30 is at a selected depth. Desirably, hydraulic release means 46 as known to the art can be provided to release snap rings 42 when desired. The hydraulic controls for such hydraulic release means are desirably positioned on platform 10 so that if necessary sleeve 30 can be removed from foundation 16. Sleeve 30 includes a first inner diameter 90 which extends from the upper end of sleeve 30 to a first shoulder 48 below which the inner diameter of sleeve 30 is increased to a second inner diameter 92 for a distance along its length to a second shoulder 50. Second shoulder 50 is shown as a support ring 54 positioned in a groove 52 positioned about the inner diameter of sleeve 30. A compression ring 68 is slideably positioned between first shoulder 48 and second shoulder 50. Compression ring 68 has an outer diameter suitable for slideably mounting compression ring 68 in second inner diameter 92 of sleeve 30 between first shoulder 48 and second shoulder 50. Compression ring 68 has an inner diameter which is substantially equal to first inner diameter 90 of sleeve 30 above first shoulder 48. Compression ring 68 also desirably includes on its upper end a tapered surface 70 which is tapered inwardly. A plug 60 is shown in position in sleeve 30. Plug 60 includes a groove 62 which contains a resiliently compressible load ring 64. Load ring 64 desirably has a tapered surface 66 on its lower outer diameter to facilitate the compression of load ring 64 as plug 60 is passed downwardly into sleeve 30. As shown in position load ring 64 engages both groove 62 in plug 60 and first shoulder 48 in sleeve 30 thereby maintaining plug 60 in position. Plug 60 also contains an arcuate support member 72 which matingly engages an arcuate member 74 positioned on a lower end of a mooring tether 14. Arcuate member 74 and arcuate support 72 are maintained in mating engagement by a shoulder 76 positioned on plug 60 which maintains a resiliently compressible spacer 78 in engagement with shoulder 76 and arcuate member 74 thus permitting rotary movement between arcuate support 72 and arcuate member 74 as platform 10 shifts and the like. Further, spacer 78 which is desirably a resiliently compressible spacer of materials known to the art such as rubber, steel, composites and the like provides some resiliency in mooring tether 14. Further, an extension 82 of the tapered surface 80 on the upper end of sleeve 30 may be provided to facilitate the positioning of plug 60 in sleeve 30. Optionally foundation 16 is conformed on its upper surface 36 to matingly engage extension 82.

The materials of construction used in the fabrication of foundation 16, sleeve 30, plug 60 and tether 14 are considered to be known to the art and form no part of the present invention.

In the use of plug 60 to connect tether 14 to foundation 16, plug 60 is moved downwardly from platform 10 to engage the upper end of sleeve 30. Plug 60 is then pushed downwardly into sleeve 30 with load ring 64 being compressed into groove 62 so that the outer diameter of load ring 64 is compressed to an outer diameter no greater than first inner diameter 90 of sleeve 30. With load ring 64 so compressed plug 60 is readily moved downwardly into sleeve 30 until load ring 64 passes first shoulder 48 at which point load ring 64 resiliently expands to substantially its original outer diameter so that when upward pressure is applied to plug 60, load ring 64 engages groove 62 in plug 60 and first shoulder 48 in sleeve 30, thereby retaining plug 60 in position to support platform 10 by the use of mooring tether 14.

When it is desired to remove plug 60 to inspect tether 14, plug 60 or the like, plug 60 is moved downwardly in sleeve 30 so that tapered surface 66 on load ring 64 engages tapered surface 70 on compression ring 68 thereby compressing load ring 64 into compression ring 68 so that when plug 60 is then raised, compression ring 68 which is now positioned about the outer diameter of load ring 64 is moved upwardly inside second inner diameter 92 of sleeve 30 until compression ring 68 engages first shoulder 48 at which point its upper motion stops with load ring 64 then sliding upwardly inside first inner diameter 90 of sleeve 30 as compressed. It is thus clear that plug 60 can be readily removed and inspected for subsequent replacement or reuse. The size of plug 60 can clearly be determined by those skilled in the art based upon the application intended. For instance, quite large mooring tethers may be used or a plurality of smaller mooring tethers may be used.

Further, it is pointed out that wide variations are possible in the length of space provided in sleeve 30 between first shoulder 48 and second shoulder 50. The primary restriction on the amount of space provided is that enough space must be provided so that load ring 64 is allowed to expand to engage groove 62 and first shoulder 48. Further, it is pointed out that second shoulder 50 may be formed as a machined shoulder positioned in sleeve 30 rather than as a ring positioned in a groove as shown. Such variations are within the skill of those in the art.

In the event that for any reason the removal of plug 60 by the method discussed above should fail, such as for instance the silting up of the connector or the like, sleeve 30 can be removed by activating hydraulic release means 46 at the surface so that sleeve 30 can be withdrawn with plug 60. Thus it is clear that by the use of the connector apparatus described herein, mooring tethers can readily be connected and disconnected to a subsea foundation thereby facilitating the use of tension leg platforms.

O-rings 53 are desirably positioned as shown to prevent the entry of silt etc. into the space between the outer diameter of sleeve 30 and the inner diameter of opening 32. An O-ring 55 is also desirably positioned as shown to prevent the entry of silt etc. into the space between the outer diameter 96 of plug 60 and first inner diameter 90 of sleeve 30. Clearly, the -rings can be positioned in any effective location and a plurality of O-rings can be used.

Having thus described the invention by reference to its preferred embodiments, it is pointed out that the embodiments described are illustrative rather than limiting in nature and that many variations and modifications are possible within the scope of the present invention. Such variations and modifications may be considered obvious and desirable by those skilled in the art upon a review of the foregoing description of preferred embodiments.

Having thus described the invention, I claim:

1. A connector apparatus for connecting a tension leg platform mooring tether to a subsea foundation, said apparatus comprising:

(a) a plug means positioned on the lower end of said mooring tether;

(b) a receptacle means positioned in said foundation, said receptacle means having a first inner diameter larger than the outer diameter of said plug and being adapted to receive said plug;

(c) a first shoulder means positioned in said receptacle means;

(d) a second shoulder means positioned in said receptacle beneath said first shoulder means;

(e) a second inner diameter section in said receptacle, said second inner diameter section being larger than said first inner diameter section and positioned beneath said first shoulder means and above said second shoulder means;

(f) a compressible load ring means positioned in a groove means in said plug, said compressible load ring having an outer diameter larger than said first inner diameter of said receptacle means and including on its lower side compression means for compressing said load ring into said groove as said load ring is passed into said first inner diameter in said receptacle means to a diameter no larger than said first inner diameter of said receptacle means, said load ring being adapted to engage said groove and said first shoulder means after passing through said first inner diameter section;

(g) a compression ring means having an outer diameter smaller than said second inner diameter section and an inner diameter substantially equal to said first inner diameter of said receptacle means, said compression ring means being slideably positioned in said second inner diameter section between said first shoulder means and said second shoulder means and adapted to compress said load ring when said plug means is lowered in said receptacle means so that as said plug means is passed into said receptacle means said load ring is compressed until said load ring has passed through said first inner diameter section of said receptacle means, with said load ring then returning to its uncompressed diameter and engaging said first shoulder means and said groove means and retaining said plug means in said receptacle means with said load ring being compressible by said compression ring upon lowering said plug means further in said second inner diameter in said receptacle means thus passing said load ring means into compressing engagement with said compression ring means which is urged into compressing engagement with said load ring by contact with said second shoulder means.

2. The apparatus of claim 1 wherein said second shoulder means comprises a support ring means positioned in a groove in said receptacle means.

3. The apparatus of claim 1 wherein said receptacle means comprises a sleeve means slideably positioned in said foundation, said sleeve means being maintained in said foundation by at least one insert ring positioned to engage a groove in the outer diameter of said sleeve means and a groove positioned about the inner diameter of the opening in said foundation in which said sleeve means is positioned.

4. The apparatus of claim 3 wherein said insert ring is releasable to permit the removal of said sleeve means from said foundation.

5. The apparatus of claim 3 wherein the upper end of said sleeve means is tapered to facilitate the insertion of said plug into said receptacle means.

6. The apparatus of claim 1 wherein said mooring tether is rotatably and resiliently connected to said plug.

7. The apparatus of claim 6 wherein said plug includes an arcuate support means positioned to rotatably engage a mating arcuate member positioned on the lower end of said mooring tether, said arcuate support means and said arcuate support member being maintained in mating engagement by a shoulder means positioned on said plug to maintain a resilient compressible spacer means in a position between said shoulder means on said plug and said arcuate member.

8. The apparatus of claim 1 wherein said compression means for compressing said load ring comprises a tapered lower surface on said load ring to facilitate the compression of said load ring as it passes into said receptacle means.

9. The apparatus of claim 1 wherein said compression ring includes a tapered surface on its upper end to facilitate compressive engagement with said load ring.

* * * * *